US012643721B1

(12) United States Patent
Ben Asher

(10) Patent No.: US 12,643,721 B1
(45) Date of Patent: Jun. 2, 2026

(54) STORAGE BOX WITH SPRING-LOADED LOCKING LID

(71) Applicant: Michael Peretz Ben Asher, Tel Aviv (IL)

(72) Inventor: Michael Peretz Ben Asher, Tel Aviv (IL)

( * ) Notice: Subject to any disclaimer, the term of this patent is extended or adjusted under 35 U.S.C. 154(b) by 0 days.

(21) Appl. No.: 19/068,017

(22) Filed: Mar. 3, 2025

Related U.S. Application Data

(60) Provisional application No. 63/747,386, filed on Jan. 21, 2025.

(51) Int. Cl.
*B65D 55/04* (2006.01)
*B65D 43/02* (2006.01)

(52) U.S. Cl.
CPC ..... *B65D 55/04* (2013.01); *B65D 43/0204* (2013.01); *B65D 2255/20* (2013.01); *B65D 2543/00972* (2013.01)

(58) Field of Classification Search
CPC .... B65D 55/00; B65D 55/04; B65D 43/0204; B65D 43/022; B65D 43/26; B65D 43/06; B65D 45/327; B65D 53/02; B65D 39/12; B65D 2255/20; B65D 2543/00972; B65D 2543/00101; B65D 2543/00231; B65D 2543/00935; B65D 2543/0099; B65D 2543/00203; B65D 2543/00296; B65D 2543/00564; B65D 2543/00342; B65D 2543/00953; B65D 2543/00092; B65D 2543/00527; B65D 2543/00925; A47J 47/02
USPC .... 220/231, 240, 212, 234, 203.1, 238, 378, 220/367.1, 323, 260, 256.1; 215/262, 215/270, 228, 260, 320, 317, 341, 359, 215/354; 206/524.8; 292/256; 141/65, 141/326; 99/472, 454
See application file for complete search history.

(56) References Cited

U.S. PATENT DOCUMENTS 1,939,569 A * 12/1933 Pfister ..... B65D 39/12 4/295
2,966,276 A * 12/1960 Leung ..... A47J 41/02 215/358
4,083,468 A * 4/1978 Batchelor ..... B65D 39/12 220/234
4,218,967 A * 8/1980 Batchelor ..... B65D 81/2038 206/524.8
4,303,171 A * 12/1981 Schremmer ..... B65D 39/12 220/281
4,316,550 A * 2/1982 de Winter ..... B65D 39/12 215/331
D296,523 S * 7/1988 Corno ..... D9/435
4,942,970 A * 7/1990 Jay ..... B65D 39/12 215/358
6,170,690 B1 * 1/2001 Hosoi ..... H10P 72/1914 206/711
7,204,383 B2 * 4/2007 Hsu ..... B65D 39/12 220/803

(Continued)

*Primary Examiner* — Orlando E Aviles
*Assistant Examiner* — Brijesh V. Patel

(57) ABSTRACT

The present invention refers to a storage box with a lid that includes a top, a bottom, two axial levers, and two snap springs with springy arms and sliding protrusions. The levers are integrated within the top and the snap springs are integrated into the bottom. When the user applies horizontal force on the levers they force the top to move up and release the lid from the container.

1 Claim, 13 Drawing Sheets

(56) References Cited

U.S. PATENT DOCUMENTS

| | | | | |
|---|---|---|---|---|
| 7,513,381 | B2 * | 4/2009 | Heng | B65D 51/1683 220/806 |
| 8,186,527 | B2 * | 5/2012 | Liu | B65D 39/12 215/354 |
| 8,479,941 | B2 * | 7/2013 | Matsumoto | B65D 39/12 220/803 |
| D717,655 | S * | 11/2014 | Rose | D7/629 |
| 8,881,927 | B2 * | 11/2014 | West | B65D 39/12 220/233 |
| D742,065 | S * | 10/2015 | Leidel | D27/162 |
| 9,731,874 | B2 * | 8/2017 | Luo | B65D 45/28 |
| 11,370,586 | B2 * | 6/2022 | Billadeau | B65D 51/1683 |
| 11,370,592 | B2 * | 6/2022 | Wang | B65D 51/1644 |
| 2004/0245251 | A1 * | 12/2004 | Heng | B65D 43/022 220/234 |
| 2006/0016778 | A1 * | 1/2006 | Park | B65D 39/12 220/238 |
| 2008/0041869 | A1 * | 2/2008 | Backaert | B65D 43/022 220/281 |
| 2010/0084365 | A1 * | 4/2010 | Liu | B65D 39/12 215/317 |
| 2010/0282748 | A1 * | 11/2010 | Lu | B65D 43/022 220/260 |
| 2013/0240532 | A1 * | 9/2013 | Lu | B65D 39/12 220/378 |
| 2013/0313219 | A1 * | 11/2013 | Pao | B65D 43/022 215/262 |
| 2016/0107805 | A1 * | 4/2016 | Luo | A47J 47/02 220/256.1 |
| 2023/0348153 | A1 * | 11/2023 | Zhang | B65D 53/02 |

* cited by examiner

STORAGE BOX WITH SPRING-LOADED LOCKING LID

TECHNICAL FIELD

This invention relates to storage containers, particularly to storage boxes with lids that secure through a spring-loaded locking mechanism.

BACKGROUND ART

Storage containers are commonly used for holding various materials. Ensuring the lid remains securely closed is essential, especially for transporting sensitive or perishable items. Traditional containers often rely on friction fits or manual clasps, which may loosen over time. This invention addresses these challenges by providing a spring-loaded locking mechanism that ensures a secure, airtight seal while allowing easy opening when necessary.

SUMMARY OF THE INVENTION

The present invention provides a storage box comprising a container, a lid, and a seal, where the lid integrates axial levers and snap springs. The axial levers engage with recesses in the lid's top portion, while snap springs positioned in the bottom portion provide a spring-loaded lock. The design allows the lid to remain tightly closed without external force and to open when horizontal force is applied to the levers.

DESCRIPTION OF THE DRAWINGS

The intention of the drawings attached to the application is not to limit the scope of the invention and its application. The drawings are intended only to illustrate the invention and they constitute only one of its many possible implementations.

DETAILED DESCRIPTION OF THE INVENTION

Figure 1:
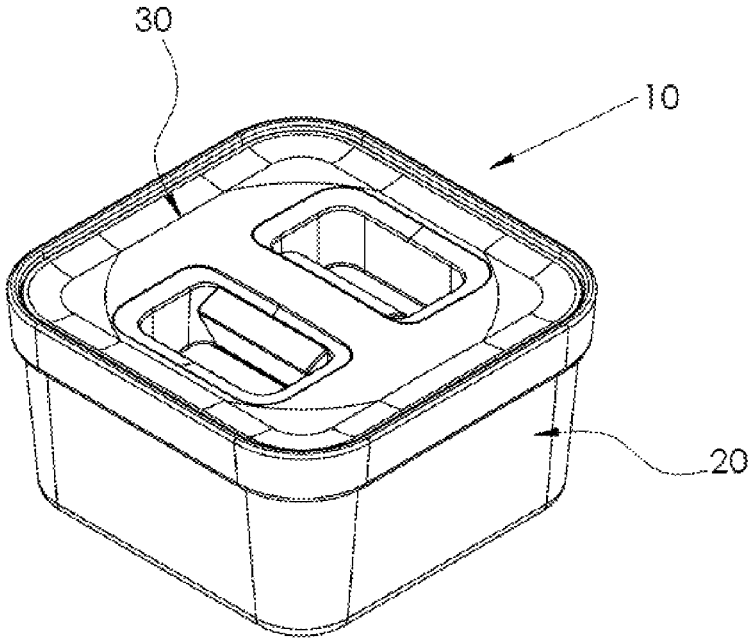
FIG. 1 depicts the storage box.

The main object of the present invention is to provide a storage box (10) that includes a container (20), a lid (30), and a seal (40). The container (20) has a peripheral wall (21) that interfaces with the seal (40). The lid (30) consists of a top portion (31) and a bottom portion (32). The top portion (31) features recesses (311R, 311L) for axial levers (33R, 33L), an upper bridge (312), and steps (314F, 314B). The bottom portion (32) includes a base (321), mounts (F322, B322), and accommodates snap springs (34F, 34B).

The axial levers (33R, 33L) engage with the top portion, while the snap springs (34F, 34B) are integrated into the bottom portion. The spring arms (341) of the snap springs flex during assembly, creating a spring-loaded lock. The lid remains closed when no force is applied and opens when horizontal force shifts the levers, releasing the seal's compression.

Figure 2:
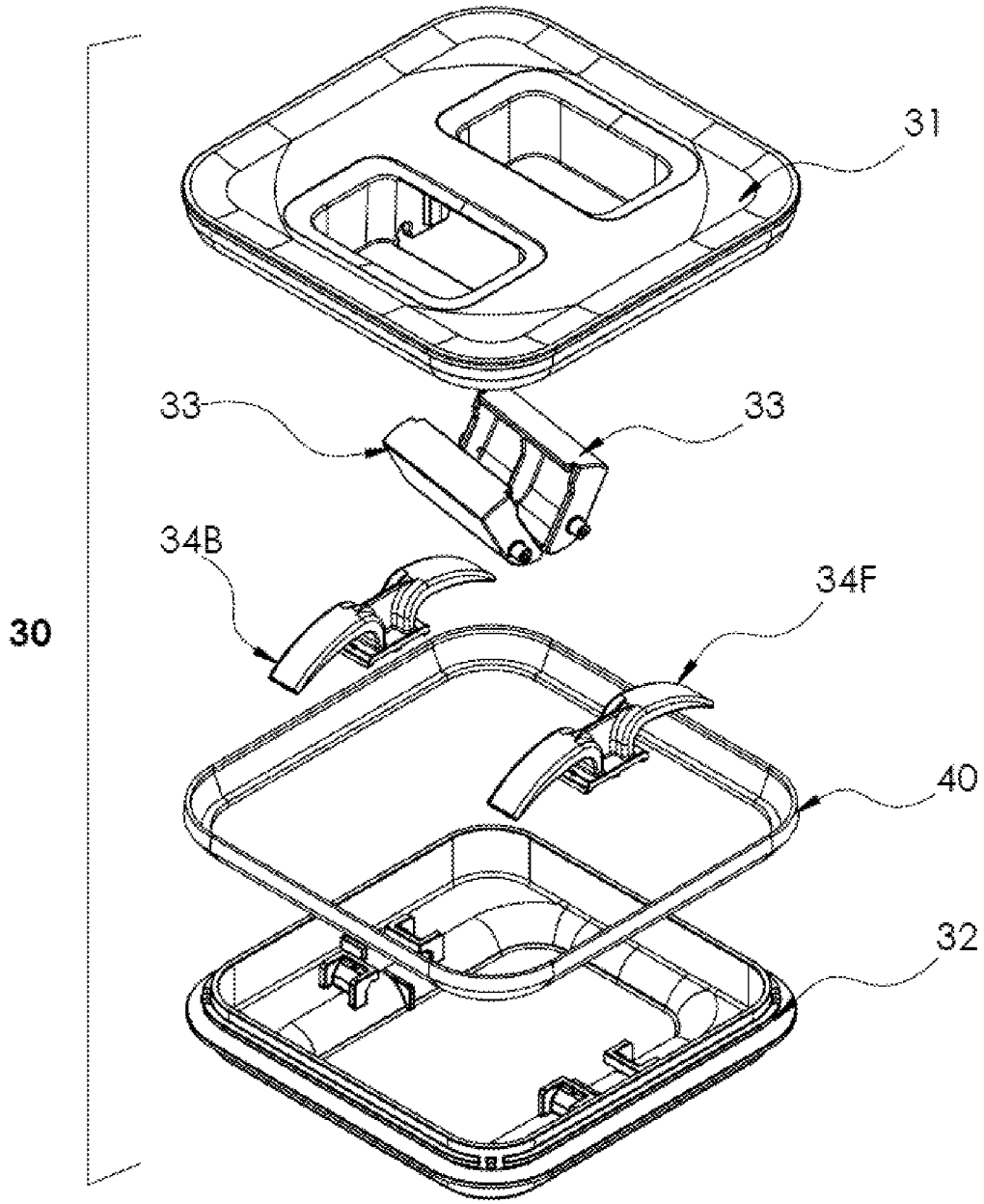
FIG. 2 is an exploded depiction of the storage box.
Figure 3:
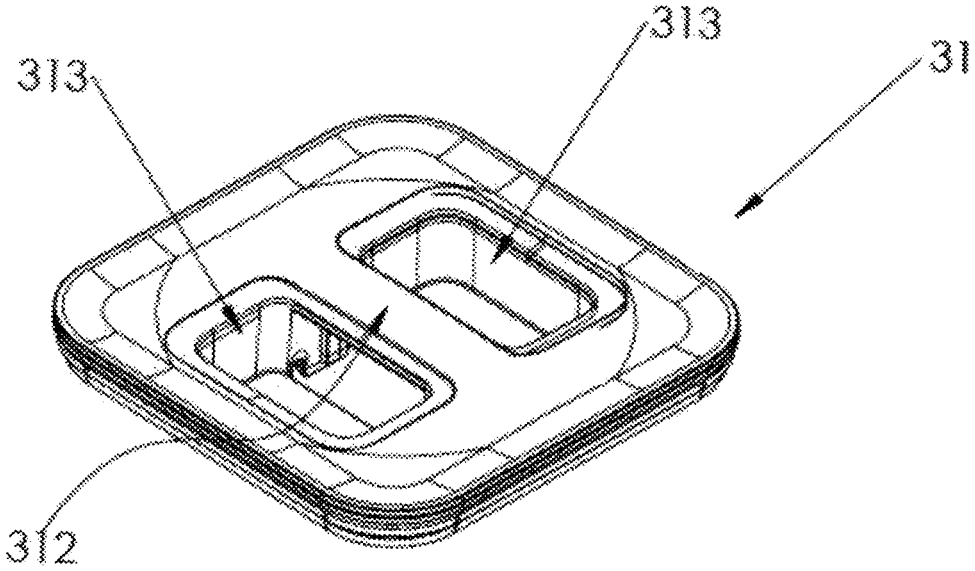
FIGS. 3-6 depict the top portion of the storage box.
Figure 4:
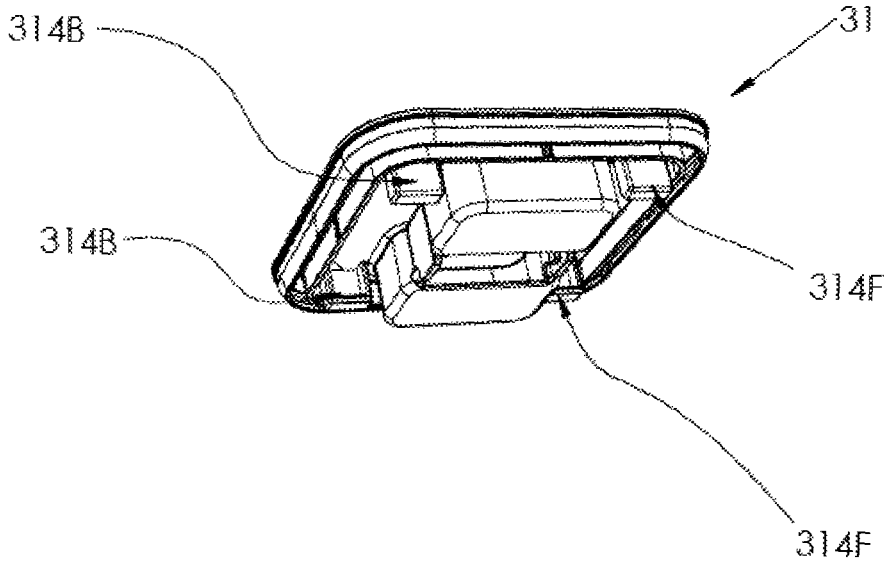
Figure 5:
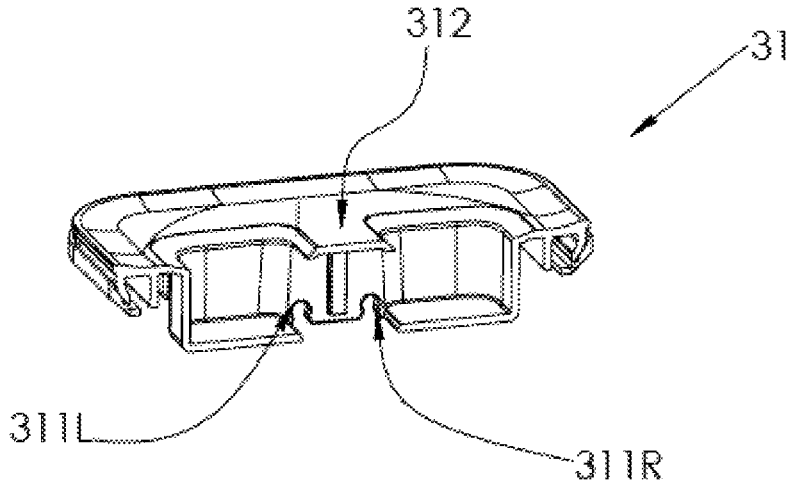
Figure 6:
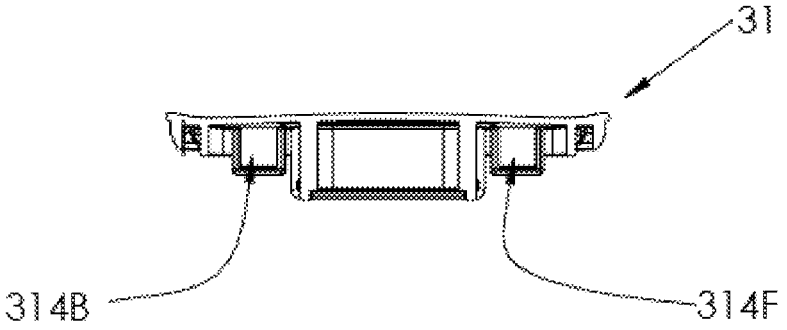
Figure 7:
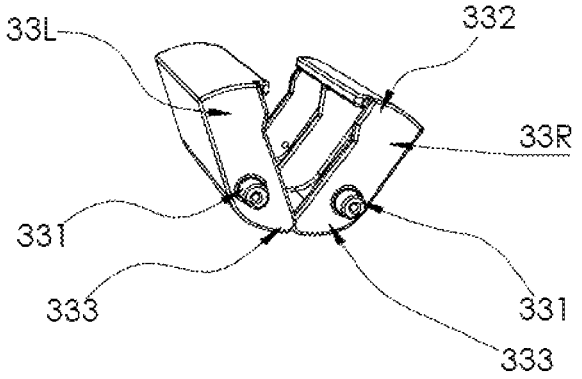
FIG. 7 depicts the levers (33).
Figure 8:
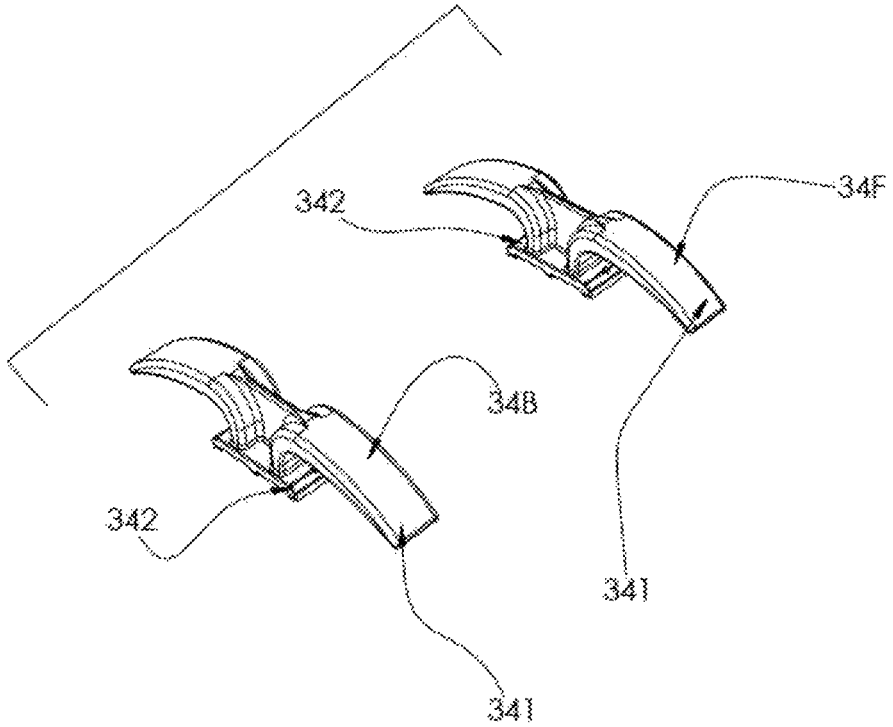
FIG. 8 depicts the springs (34).
Figure 9:
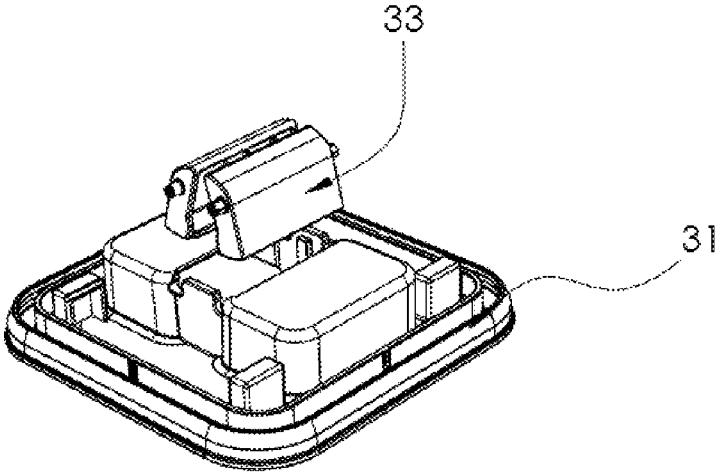
FIGS. 9 and 10 depict the top portion and the levers and the way of assembling.
Figure 10:
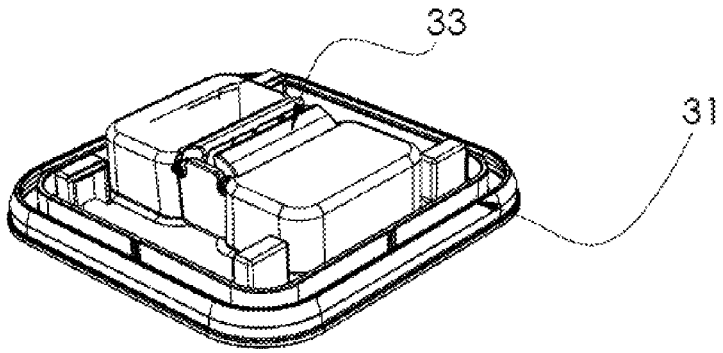
Figure 11:
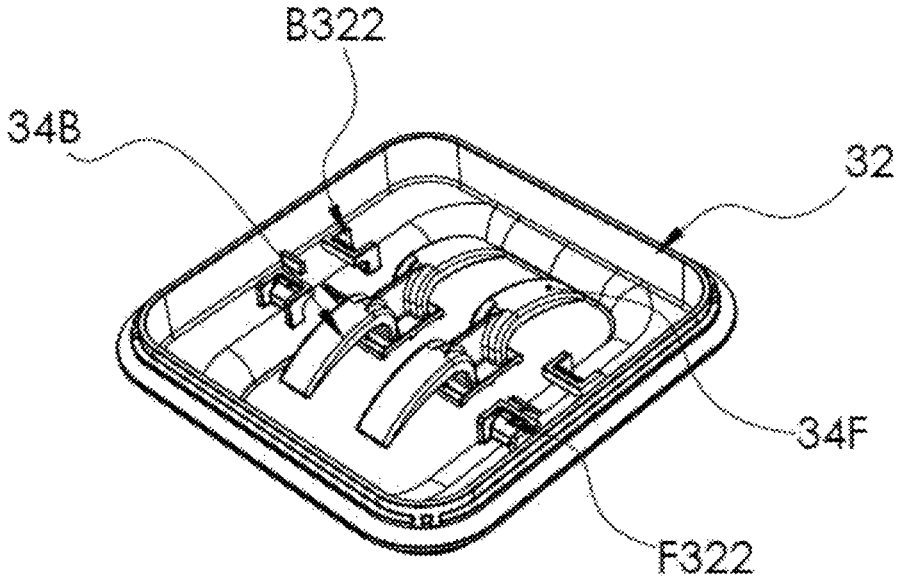
FIGS. 11 and 12 depict the bottom portion and the springs and the way of assembling.
Figure 12:
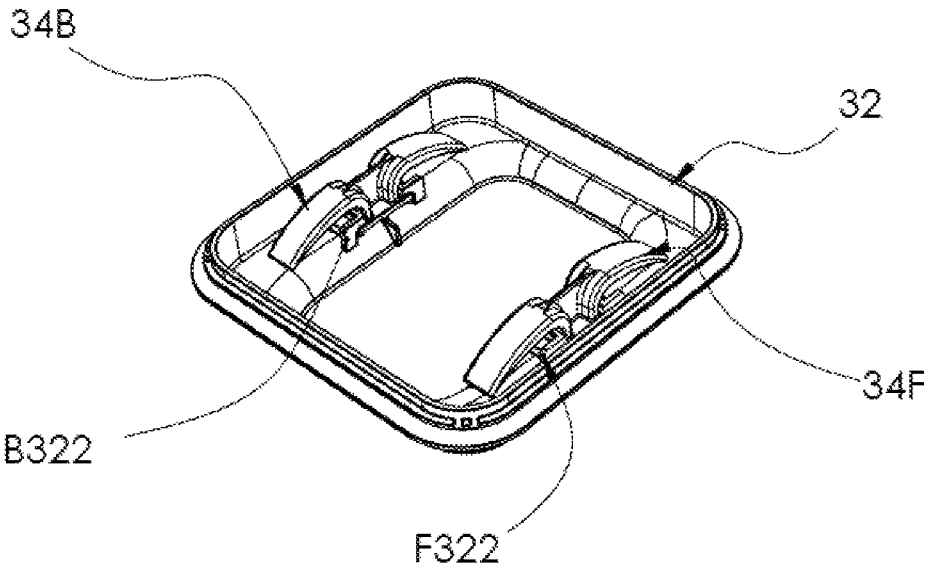
Figure 13:
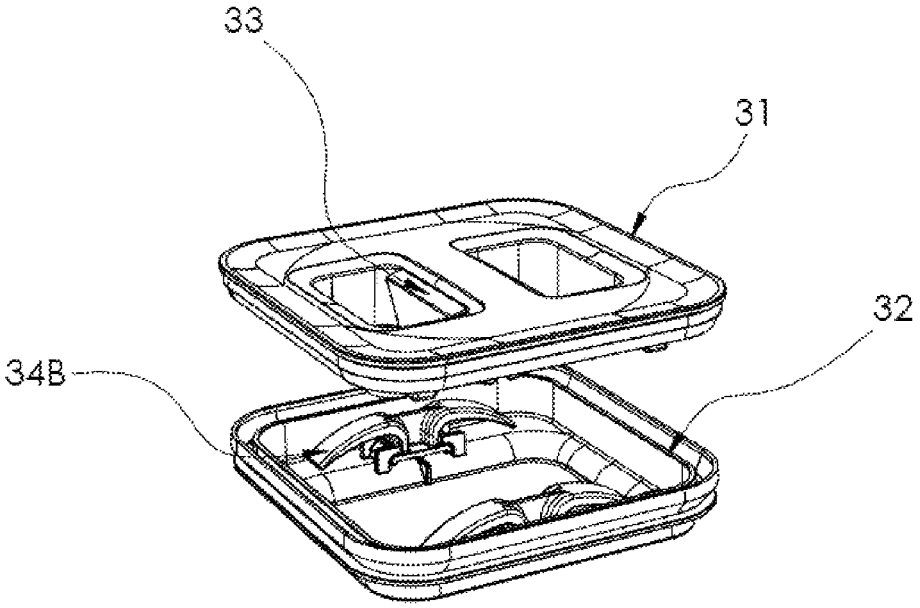
FIGS. 13-16 depict the bottom and the top portions and the way of assembling.
Figure 14:
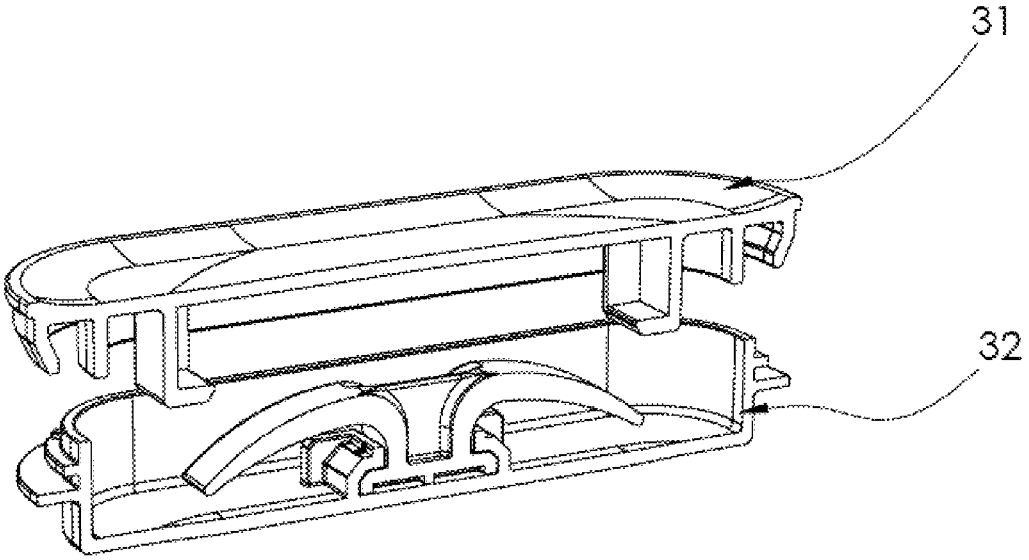
Figure 15:
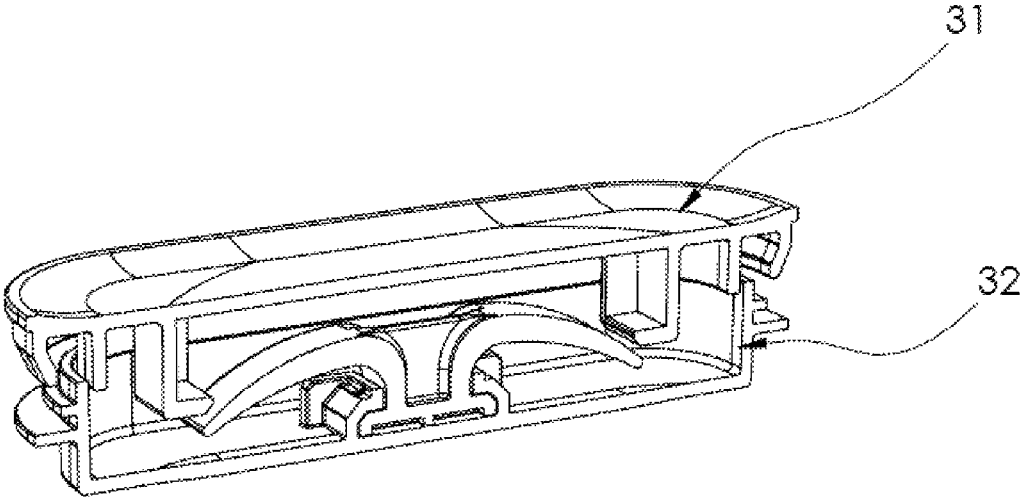
Figure 16:
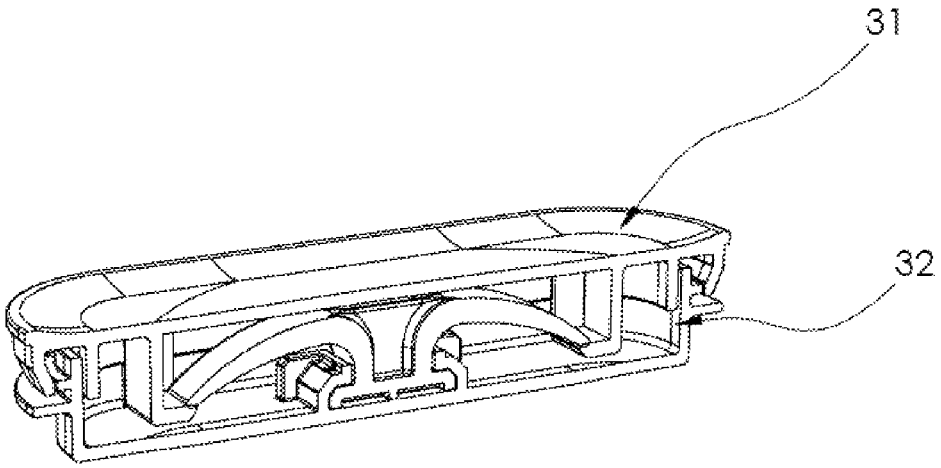
Figure 17:
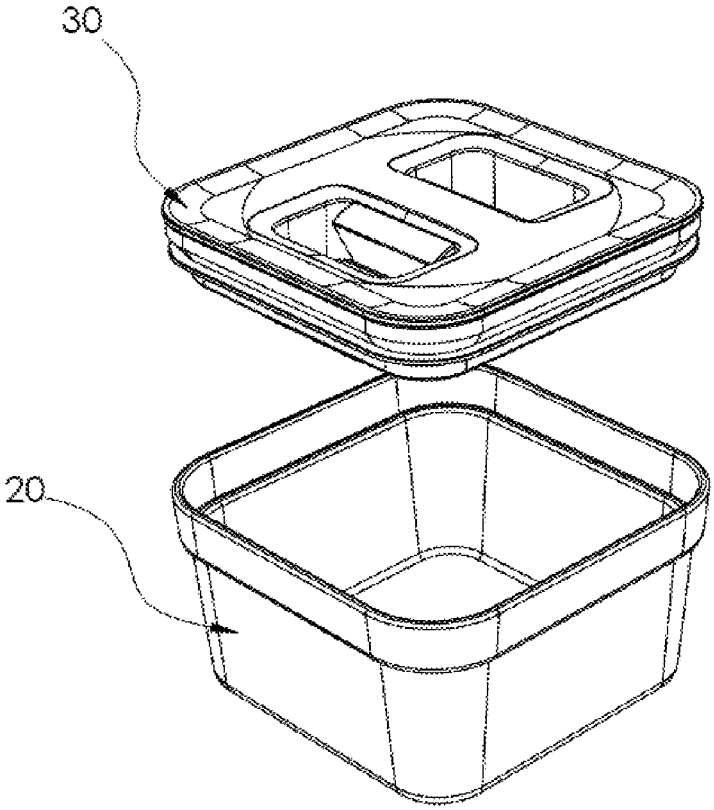
FIGS. 17-20 depict the storage box when the lid is in the tight position.
Figure 18:
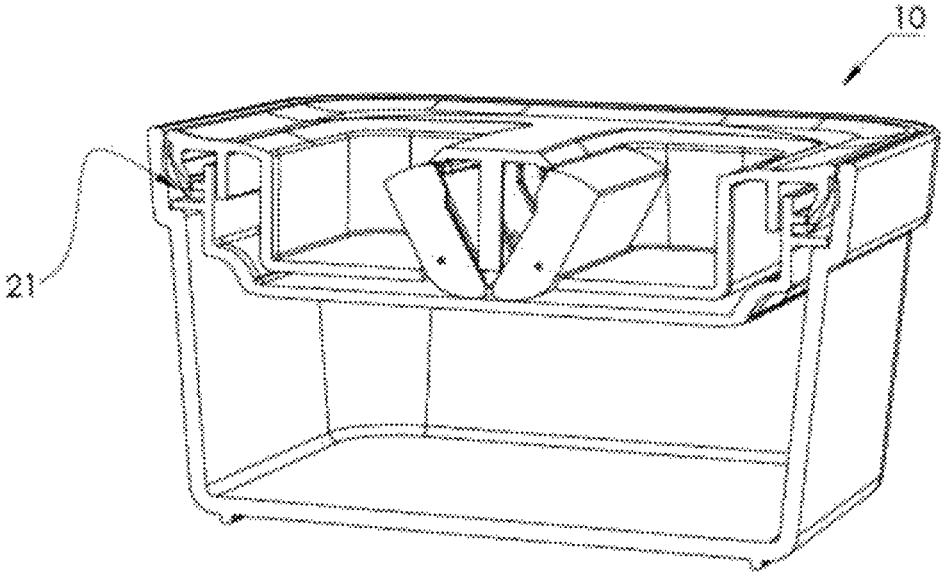
Figure 19:
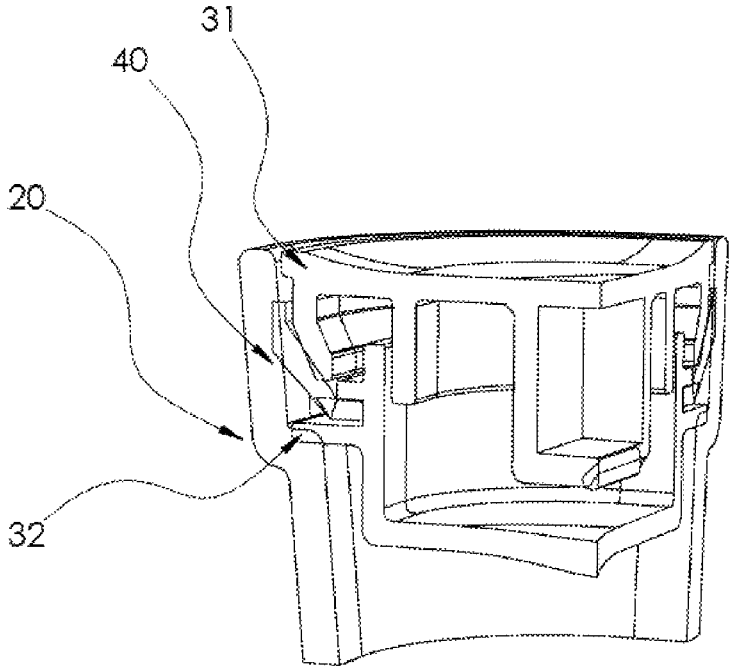
Figure 20:
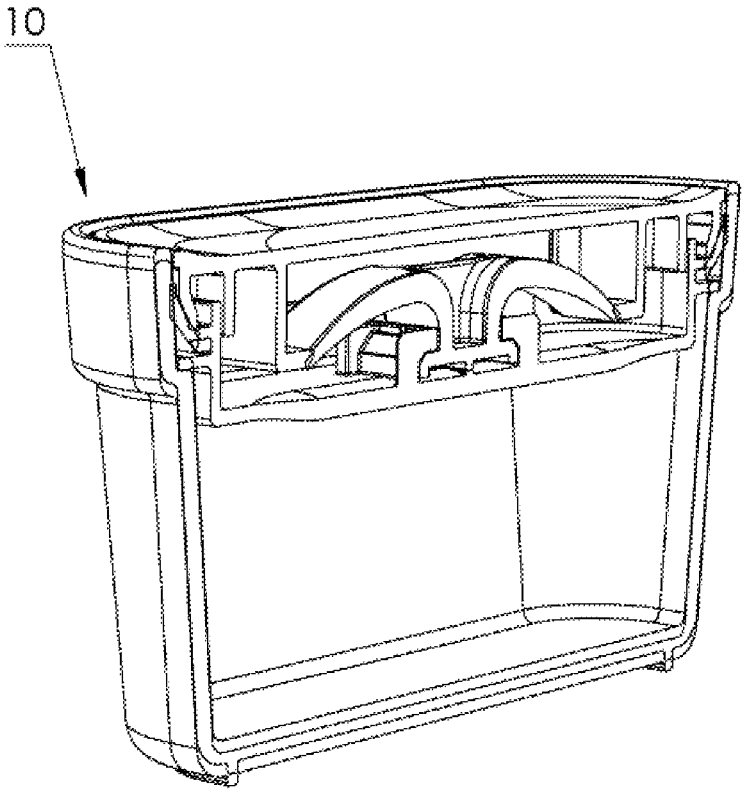
Figure 21:
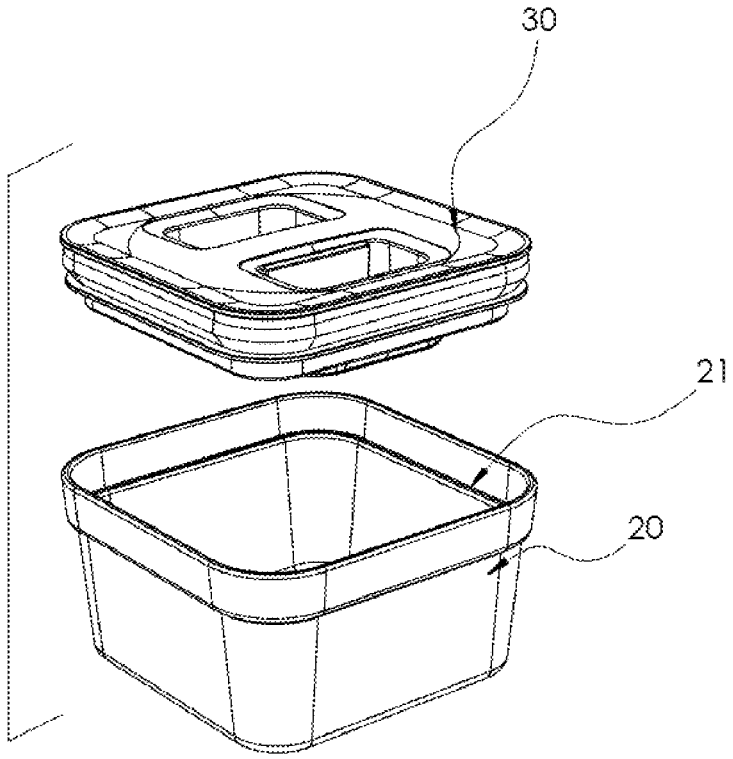
FIGS. 21-24 depict the storage box when the lid is in the released position.
Figure 22:
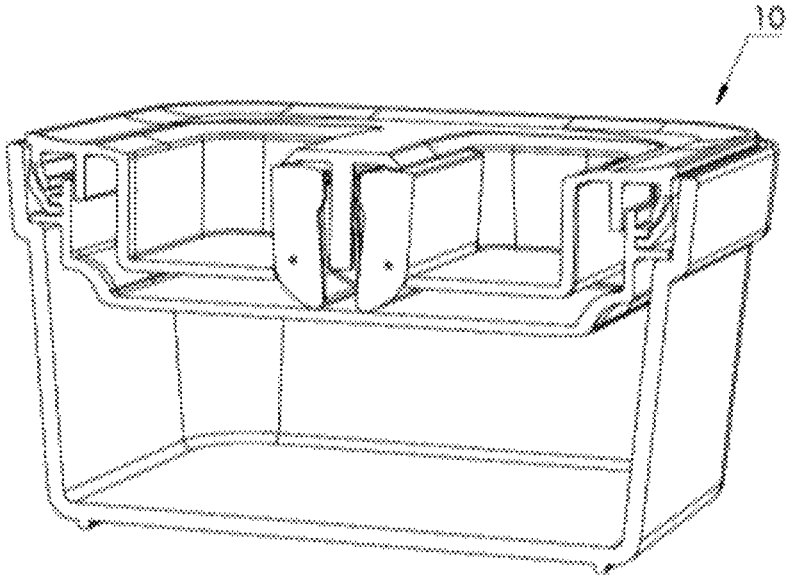
Figure 23:
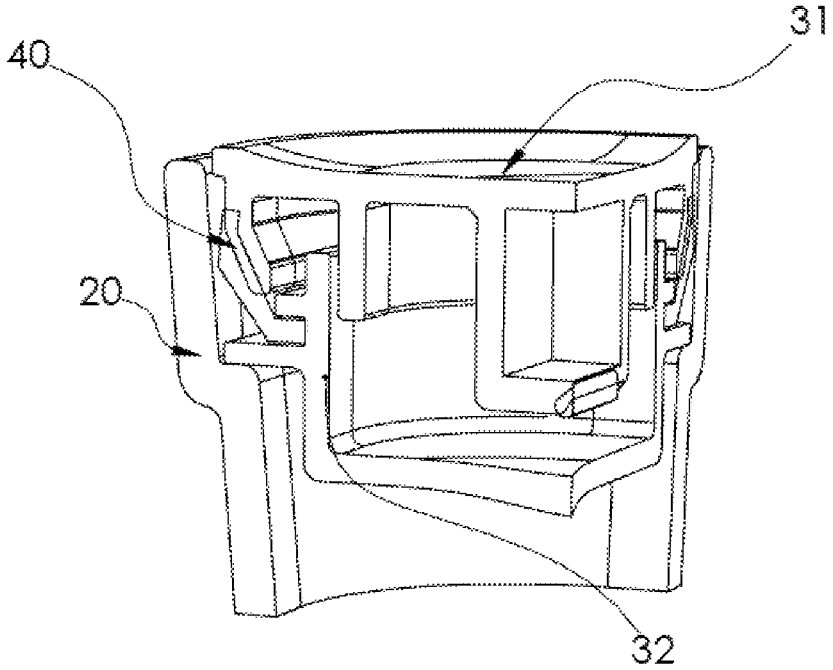
Figure 24:
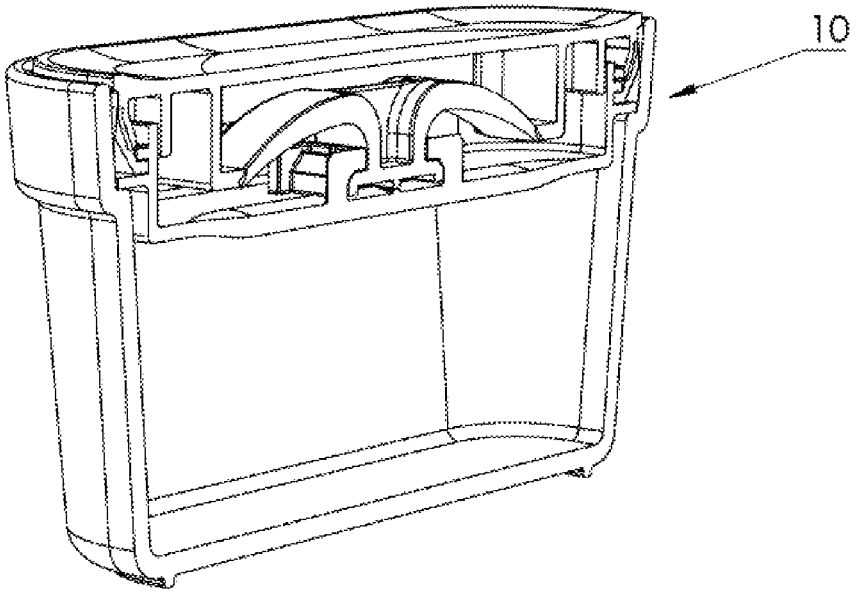

FIG. 1 depicts the storage box (10). FIG. 2 is an exploded depiction of the storage box. FIGS. 3-6 depicts the top portion of the storage box. FIG. 7 depicts the levers (33). FIG. 8 depicts the springs (34F, 34B). FIGS. 9 and 10 depict the top portion and the levers and the way of assembling them together. FIGS. 11 and 12 depict the bottom portion and the springs and the way of assembling them together. FIGS. 13-16 depict the bottom and the top portions and the way of assembling them together. FIGS. 17-20 depict the storage box in several views when the lid is in the tight position, and FIGS. 21-24 depict the storage box in several views when the lid is in the released position.

The storage box (10) comprising the container (20) that is designed to hold materials, the lid (30) that is designed to cover the container, and the seal (40) that is designed to provide a secure closure between the lid and the container.

The lid (30) comprises a top portion (31), a bottom portion (32), a right axial lever (33R), a left axial lever (33L), each including two horizontal protrusions (331), and a front snap spring (34F), a back snap spring (34B), each including two springy arms (341) and a sliding protrusion (342).

The axial levers (33R, 33L) are integrated within the top portion (31), and the top further comprises two right recesses (311R) accommodating the horizontal protrusions of the right lever, two left recesses (311L) accommodating the horizontal protrusions of the left lever, an upper bridge (312) under which the two axial levers are positioned side by side, two upper openings (313) enabling access to the axial levers, two front steps (314F) on which the arms of the front snap spring are positioned, and two rear steps (314B) on which the arms of the back snap spring are positioned.

The snap springs (34F, 34B) are integrated into the bottom portion (32), and the bottom further comprises a base (321), a front mount (F322) accommodating the sliding protrusion of the front snap spring (34F), and a rear mount (B322) accommodating the sliding protrusion of the back snap spring (34B).

The lid (30) is assembled by snapping the top portion (31), which already includes the axial levers, onto the bottom portion (32), which already includes the snap springs, in such a way that the spring arms (341) flex downward as they engage the steps (314F, 314B), then settle onto the steps, thereby securing the top and bottom together with a spring-loaded lock.

The snap springs (34F, 34B) are positioned in the lid such that their sliding protrusions (342) are integrated into the bottom portion (32), while their springy arms (341) rest on the steps of the top portion (31), creating a spring-loaded locking mechanism.

The axial levers (33R, 33L) are positioned in the lid between the upper bridge (312) of the top portion and the base (321) of the bottom portion, allowing them to be in a diagonal position when no horizontal force is applied to the upper parts (332) of the levers, and to move into a vertical position when a horizontal force is applied to the upper parts of the levers, causing them to shift closer together.

The lid (30) is designed to be in a tight state when no horizontal force is applied to the axial levers (33R, 33L), as the snap springs (34F, 34B) press the top portion (31) against the bottom portion (32), thereby compressing the seal (40) against the peripheral wall (21) of the container (20) to ensure a secure and airtight closure.

The lid (30) is designed to be in a release state when a horizontal force is applied (by the fingers of the user that have access through the upper openings of the top portion) to the axial levers (33R, 33L), overcoming the spring force of the snap springs (34F, 34B) and shifting the levers into a vertical position, thereby: (a) causing the lower parts (333) of the levers to slide along the base (321) of the bottom portion (32); (b) raising the top portion (31) relative to the bottom portion (32); and (c) releasing the compression of the seal (40) against the container's peripheral wall (21), allowing the lid (30) to be removed from the container (20).

This design ensures a secure, airtight storage solution with an intuitive locking mechanism, suitable for various applications. The unique structure of this storage box offers several advantages. All parts can be manufactured from plastic, making the production cost-effective and suitable for mass manufacturing. The design enables tool-free assembly, as the components securely connect through a SNAP click mechanism, eliminating the need for screws or metal springs. This all-plastic construction allows the container to be safely used in microwaves and environments where metal components are prohibited, such as secure facilities or medical settings. This enhances the versatility and practicality of the storage box in various applications.

In the closed state, when no horizontal force is applied to the axial levers, the snap springs exert downward pressure on the top portion, securely clamping it against the bottom portion. This downward force compresses the seal (rubber band) against the inner wall of the container, ensuring both an airtight seal and a secure closure. When the axial levers are pinched together, they move closer, causing the top portion to lift upward due to the levers' mechanical advantage. This upward movement releases the pressure on the seal, allowing the lid to be easily removed from the container.

What I claim is:

1. A storage box (10) comprising a container (20) designed to hold materials, a lid (30) designed to cover the container, and a seal (40) designed to provide a secure closure between the lid and the container;

wherein the lid (30) comprises: a top portion (31) and a bottom portion (32); a right axial lever (33R) and a left axial lever (33L), each including two horizontal protrusions (331); a front snap spring (34F) and a back snap spring (34B), each including two springy arms (341) and a sliding protrusion (342);

wherein the axial levers (33R, 33L) are integrated within the top portion (31), and the top further comprises: two right recesses (311R) accommodating the horizontal protrusions of the right lever; two left recesses (311L) accommodating the horizontal protrusions of the left lever; an upper bridge (312) under which the two axial levers are positioned side by side; two upper openings (313) enabling access to the axial levers; two front steps (314F) on which the arms of the front snap spring are positioned; and two rear steps (314B) on which the arms of the back snap spring are positioned;

wherein the snap springs (34F, 34B) are integrated into the bottom portion (32), and the bottom further comprises: a base (321); a front mount (F322) accommodating the sliding protrusion of the front snap spring (34F); and a rear mount (B322) accommodating the sliding protrusion of the back snap spring (34B);

wherein the lid (30) is assembled by snapping the top portion (31), which already includes the axial levers, onto the bottom portion (32), which already includes the snap springs, in such a way that the spring arms (341) flex downward as they engage the steps (314F, 314B), then settle onto the steps, thereby securing the top and bottom together with a spring-loaded lock;

wherein the snap springs (34F, 34B) are positioned in the lid such that their sliding protrusions (342) are integrated into the bottom portion (32), while their springy arms (341) rest on the steps of the top portion (31), creating a spring-loaded locking mechanism;

wherein the axial levers (33R, 33L) are positioned in the lid between the upper bridge (312) of the top portion and the base (321) of the bottom portion, allowing them to: be in a diagonal position when no horizontal force is applied to the upper parts (332) of the levers, and move into a vertical position when a horizontal force is applied to the upper parts of the levers, causing them to shift closer together;

wherein the lid (30) is designed to be in a tight state when no horizontal force is applied to the axial levers (33R, 33L), as the snap springs (34F, 34B) press the top portion (31) against the bottom portion (32), thereby compressing the seal (40) against a peripheral wall (21) of the container (20) to ensure a secure and airtight closure;

wherein the lid (30) is designed to be in a release state when a horizontal force is applied to the axial levers (33R, 33L), overcoming the spring force of the snap springs (34F, 34B) and shifting the levers into a vertical position, thereby: (a) causing the lower parts (333) of the levers to slide along the base (321) of the bottom portion (32); (b) raising the top portion (31) relative to the bottom portion (32); and (c) releasing the compression of the seal (40) against the container's peripheral wall (21), allowing the lid (30) to be removed from the container (20).

* * * * *